US006581591B1

(12) United States Patent
Green et al.

(10) Patent No.: US 6,581,591 B1
(45) Date of Patent: Jun. 24, 2003

(54) SAFETY MEASURES FOR KAYAKS AND OTHER CRAFT

(76) Inventors: Ian Green, 35 Lilian Avenue, Action, London, W3 9AN (GB); Graham Brown, 66 Church Road, Fleet, Hampshire GU13 8LB (GB)

( * ) Notice: Subject to any disclaimer, the term of this patent is extended or adjusted under 35 U.S.C. 154(b) by 0 days.

(21) Appl. No.: 09/831,423

(22) PCT Filed: Nov. 5, 1999

(86) PCT No.: PCT/GB99/03679

§ 371 (c)(1),
(2), (4) Date: May 7, 2001

(87) PCT Pub. No.: WO00/27695

PCT Pub. Date: May 18, 2000

(30) Foreign Application Priority Data

Nov. 6, 1998 (GB) ..... 9824443

(51) Int. Cl.[7] ..... A61M 15/00
(52) U.S. Cl. ..... 128/202.13; 114/347
(58) Field of Search ..... 128/201.11, 201.26, 128/201.28, 202.13, 202.15, 207.16; 137/908; 114/347

(56) References Cited

U.S. PATENT DOCUMENTS

| | | | | |
|---|---|---|---|---|
| 4,324,234 A | * | 4/1982 | Maness | 128/207.16 X |
| 5,535,734 A | | 7/1996 | Lu et al. | 128/201.27 |
| 5,606,967 A | | 3/1997 | Wang | 128/201.27 X |
| 5,671,694 A | * | 9/1997 | Schoettle | 114/347 |

FOREIGN PATENT DOCUMENTS

DE 3931968 A1 4/1991

* cited by examiner

*Primary Examiner*—Robert M. Fetsuga
(74) *Attorney, Agent, or Firm*—Jensen & Puntigam, P.S.

(57) ABSTRACT

An emergency breathing apparatus for breathing under water particularly when using a kayak (1) comprising a single flexible tub (4) having an internal volume which is less than normal lung capacity and having an inlet adjacent one end of said tube which is arrange to be maintained above water level and open to ingress of air and adjacent the other end of said tube in close proximity a mouthpiece an a valve means operable by a user to inhibit flow of water into the breathing means in a closed condition and to permit breathing when in an open condition.

5 Claims, 2 Drawing Sheets

FIG. 4
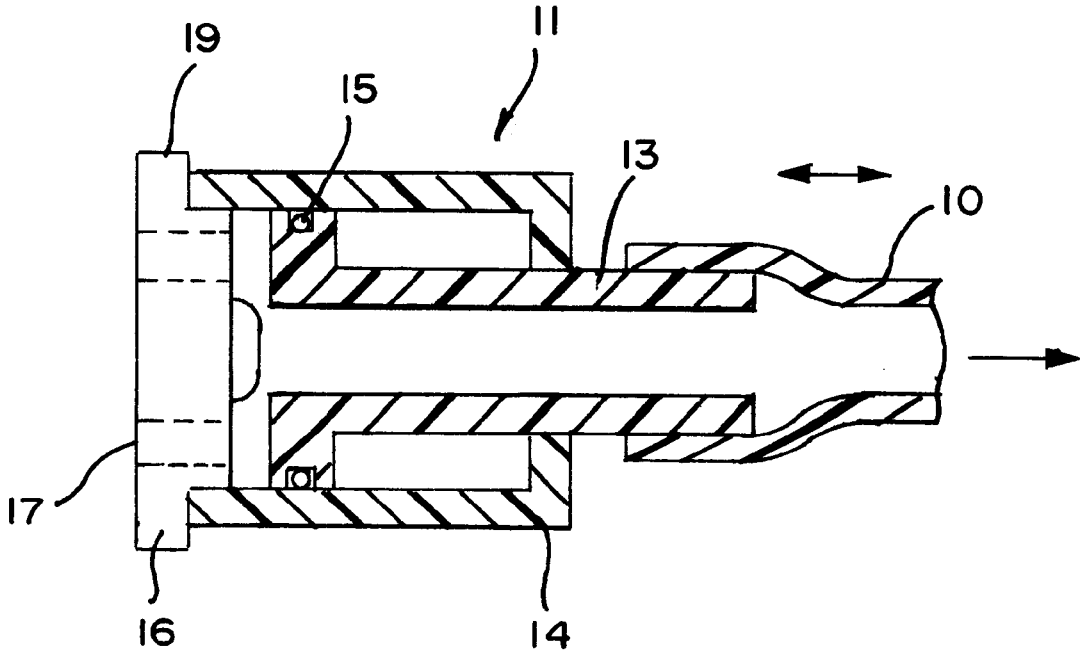
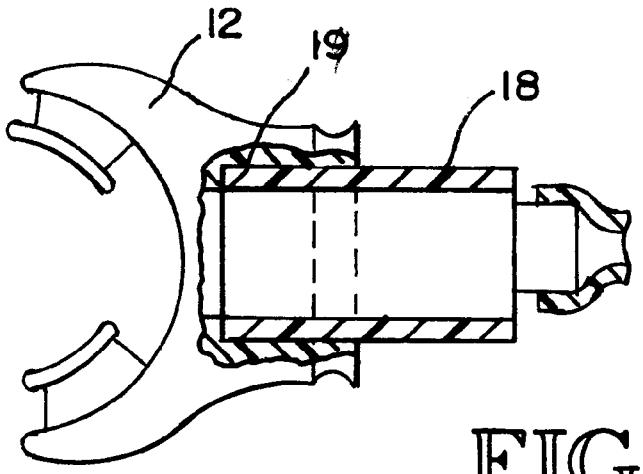
FIG. 5

SAFETY MEASURES FOR KAYAKS AND OTHER CRAFT

The present invention relates to safety measures for kayaks and other buoyant craft; and more particularly deals with problems relating to capsizing.

In this specification we use the term kayak to include not only kayaks derived from the traditional kind which originated in the Arctic circle, but also Canadian racing canoes which are in the kayak style by having a closed-in deck. These contrast with the traditional American Indian canoe which is fully open and has little or no decking, and does not present any great problem when capsized. The invention is however also applicable to other buoyant craft such as sailing dinghies which entrap or enclose a quantity of air when in the inverted or capsized condition, and where the user can be trapped in rigging when there is a capsize.

Now the problem with the kayak style craft is that if it capsizes the paddler may have difficulty getting out while it remains inverted. The problem becomes particularly acute when the paddler uses a spray cover attached to his person to fully seal the interior of the kayak against ingress of water and spray.

For this reason he has to be proficient at righting the kayak with his paddle, and self-righting is an essential part of the training for novices.

Now real danger will exist if the kayak becomes trapped in an inverted position since the paddler has to either release and right the kayak or he has to release the spray cover and get out of the kayak, all within a matter of minutes. This may happen for example if the paddler is experiencing fierce conditions in say a swollen river and the kayak is capsized and then trapped by rocks or tree roots in an inverted position.

The paddler has to free the kayak, or get out of the kayak, in the few minutes of time available. The sense of emergency and general panic may make taking either of these actions more difficult, giving rise to a risk of drowning.

In the case of sailing dinghies a similar problem can arise if a person becomes trapped in the rigging when the craft capsizes.

The present invention aims to mitigate these problems by making more time available within which to take the necessary actions. This in turn should increase user confidence and reduce the panic factor associated with a kayak or other capsize, both for the experienced person in extreme conditions and for the novice where confidence is important.

The invention is additionally ideally suited for those kayaking enthusiasts participating in:

1 Kayaking expeditions on large rivers—some with very difficult grades of fast flowing water.

2 Kayak rodeos—competitions often held on weirs where the paddler puts the kayak through many difficult somersault type manoeuvres using where possible the forces available in the moving water.

3 Play boating—where paddlers have fun in stoppers and wave patterns on fast flowing sections of rivers.

4 Surfers—kayaking on sea wave formations.

5 Sea kayaking where traversing large sections of open water are sometimes a necessity and where evacuation and re-entry would be particularly hazardous.

Now it is known from DE 3 931 968 to provide a breather tube in a kayak so that when the kayak is inverted it will be possible to breathe from air contained within the kayak hull. However, this suffers from the problem that the lower end of the tube is at the highest point in the kayak, so that when inverted the tube is then at the lowest point and is likely to communicate with water. This problem is accentuated by the fact that the system uses a simple piece of tubing with no valving of any kind, and therefore even if the inlet position were to be changed, stray water would still be likely to enter the tube prior to the user putting the end in his mouth, and so the user would have to expel that water before they could commence to breathe through the tube. Bearing in mind the possible panic situation of a paddler in these conditions, such a proposal would be unsafe, particularly for use by novices.

U.S. Pat. Nos. 5,606,967 and 5,535,734 each disclose surface breathing devices for use in diving or quasi snorkelling operations, but each uses a long length of tubing and either would not work or would be unduly complex.

The present invention aims to overcome these problems and accordingly provides an emergency breathing device for breathing under water comprising a single flexible tube having an inlet adjacent one end of said tube which is arranged to be maintained above water level and open to ingress of air and adjacent the other end of said tube in close proximity a mouthpiece and a valve means operable by a user to inhibit flow of water into the breathing means in a closed condition and to permit breathing when in an open condition. Preferably the tube should have an internal volume which is less than normal lung capacity.

Such a device may be provided in a buoyant vessel such as a kayak or dinghy, and have its open end attached within the vessel so as to communicate with air which is above waterlevel within the vessel when inverted.

Alternatively the open end may have a form of float to maintain it above waterlevel in any convenient manner such as is described in the U.S. Pat. Nos. 5,606,967 and 5,535,734. This enables an assisting swimmer to aid a trapped kayaker.

Apparatus in accordance with the invention may comprise a life jacket or buoyancy aid and a tube attached thereto having one end including said valve means and located within reach of the user for breathing into, and the other end being capable of being retained within the interior of the hull at a level above the waterline of the vessel when inverted.

In another form of the invention a craft having a buoyant hull which entraps air when inverted is equipped with breathing means in the form of a tube having one end communicating with the interior of the craft hull and the other end being located in a position where it can be reached by the user for breathing into and including valve means operable by a user to inhibit flow of water into the breathing means in a closed condition and to permit breathing when in an open condition and having an inlet which is above the waterline of the vessel when inverted.

Thus, the tubing may be provided as part of the craft itself or as part of the life jacket or buoyancy aid to be used when in such a craft, or it may be an independent surface breathing aid.

Generally the length of tubing used should include a volume which is less than a person's lung capacity. This ensures that fresh air will always be breathed in a simple way. The valve means is also important in an emergency situation since it ensures that the user can breathe air immediately without having to expel air first. The invention is different from the conventional snorkel since the tubing is flexible and enables a swimmer greater flexibility, as well as having a convenient valving system to allow air to be breathed immediately.

In practice when used in a craft, there may be some water at the bottom of the craft while it is upright, and also when inverted there may be some water at the then lowermost point. Therefore the interior end of the tube should preferably be attached at a mid-point within the hull, so that both in the upright and the inverted positions the end of the tubing is free of water. This ensures maximum usage of the entrapped air.

An embodiment of the invention will now be described by way of example with reference to the accompanying diagrammatic drawings in which:

FIG. 4 shows a sectional view of a valve for use in the breathing device, and FIG. 5 shows a sectional view of a mouthpiece for use in the breathing device.

Figure 1:
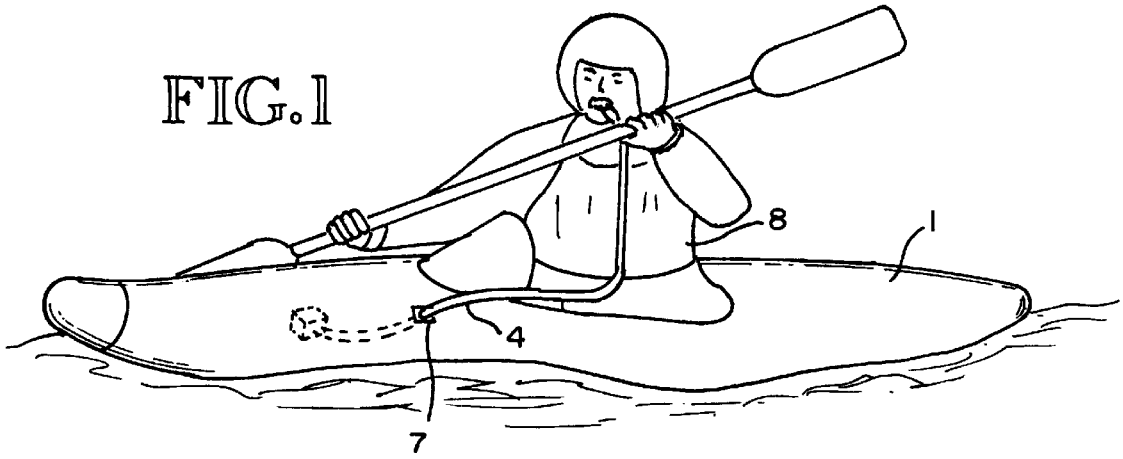
FIG. 1 is a perspective view of a paddler in a kayak.
Figure 2:
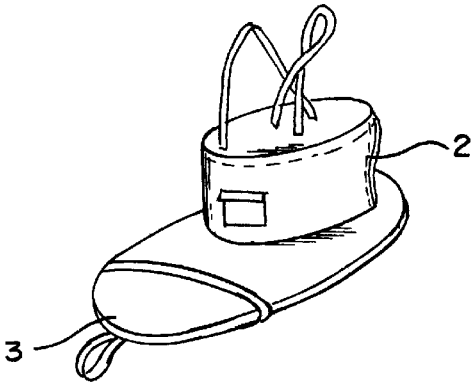
FIG. 2 shows a spray cover.

Referring to FIG. 1, a paddler is shown in a kayak 1 with a breathing device 4 in position. Generally, particularly for rough conditions, the paddler will wear a spray cover 2 similar to or of the kind shown in FIG. 2 which is attached to a lip of the cockpit by a releasable elastic or rubber cord 3. In normal use therefore if the paddler becomes trapped in an inverted position after a capsize, the spray cover 2 has to be released so that the paddler can get out of the craft.

The present invention recognises that there is a serious danger problem if the paddler cannot get out in time or if he is trapped. Moreover even if he is capable of getting out in time, for novices the mere thought of having to evacuate under those conditions can give rise to a serious confidence problem.

Figure 3:
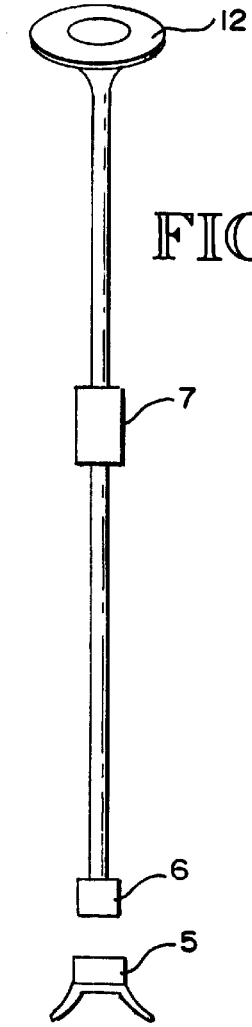
FIG. 3 shows a breathing device in accordance with the invention.

A breathing device 4 including a tube 10 is shown in FIG. 1 and this is attached at its far end 6 to a bracket 5 in FIG. 3 which is mounted in a central region of the craft, i.e. so that it is above any water which may be in the vessel in either its upright or its inverted conditions.

The end 6 of the tube may either open directly into the interior of the hull, or into a bag or other enclosure including air and contained within the hull.

At this region, i.e. near his mouth, there is a mouthpiece 12 similar to the mouthpiece of a snorkel but with valving incorporated so that the user can breathe in or out through the tube 10; and being manually operable so that is can be kept closed prior to use to prevent ingress of water, and then can be opened when the user has the mouthpiece in his mouth and wishes to breathe.

The length of tube in conjunction with its bore should be such that its total volume remains less than that of the normal lung capacity so that it is possible to blow fully through the tube to expel stale air and then draw in further fresh air without a remnant of stale air permanently remaining within the tube.

Referring to FIG. 4, a manually operated valve 11 is shown. It is attached to the end of the breathing tube 10 and is then itself attached to a shaped mouthpiece 12. The mouthpiece 12 is a conventionally shaped mouthpiece with tooth grips of the kind used in breathing apparatus such as a snorkel.

Referring back again to FIG. 4, the valve 11 comprises a valve stem 13 of a suitable plastics material which is a sliding fit within a valve body 14 to which it is slidingly sealed via an O-ring 15. The valve stem has an internal bore of approximately 12 mm diameter for passage of air. This bore is approximately the same as the tube and enables a tube of about one metre to be used with a suitable air volume which is below lung capacity. Attached to the end of the valve body is a perforated op cap 16 which is an interference fit within the valve body 14. The top cap 16 has a series of peripheral perforations or passageways 17 communicating with the mouthpiece 12 when the valve 11 is in an open condition and sealing to an end face of the valve stem when the valve is in a closed condition. The perforations have a total area approximating to the 12 mm bore area of the valve stem 13.

The valve snaps into a sleeve 18 held within a correspondingly moulded cavity within the mouthpiece 12 and it is maintained in that position by a step 19 provided in the end of the top cap 16 and engaging the end of the sleeve 18.

Prior to coming into use for breathing, the valve stem 13 will be in contact with the perforations 17. This therefore ensures that the valve is fully closed off and water cannot at that stage enter into the tube 10.

In a capsize condition where a user needs to breathe through the mouthpiece, the first thing he has to do it is to put the mouthpiece in his mouth and then pull the mouthpiece away from the valve stem 13 and this then opens the passageway 17 and thereby enables air from the capsized vessel to flow through the bore of valve stem 13 and thence into the mouthpiece 12.

Thus in use, a user can immediately obtain air by simply putting the mouthpiece in his mouth, pulling to open up the valve and hence its passageway, and then breathe air from an air store entrapped within the inverted hull.

The invention can also be used as an unattached breather in which case a longer but narrower bore tube, for example two metres long and a bore of about 8 mm, would be used within the same lung volume constraints,and with some form of protection to minimise ingress of splashed water, but generally having a flotation system such as is shown in the acknowledged U.S. Pat. Nos. 5,606,967 and 5,535,734.

Alternatively a single but slightly wider bore or longer tube can be used and the user be trained to only breathe inwards through the pipe and to expel air from his or her lungs directly into the water. A non-return valve can then be incorporated within or next to the mouthpiece to expel used air directly into the water.

What is claimed is:

1. An emergency breathing apparatus for breathing under water comprising a single flexible tube having an inlet adjacent one end of said tube which is arranged to be maintained above water level and open to ingress of ambient air and adjacent the other end of said tube in close proximity a mouthpiece and a valve operable by a user to inhibit flow of water into the breathing apparatus in a closed condition and to permit breathing when in an open condition, wherein said valve comprises a bored stem slidingly fitting with a cylindrical valve body and being slidable by an operator between the closed condition and the open condition where air can be breathed through said valve stem, perforations of the end cap providing an air communication path between an interior of the flexible tube and the mouthpiece when the valve is in the open condition and the perforations being sealed to said vavle stem when the valve is in the closed condition.

2. The apparatus of claim 1 where arranged for use with a vessel of the kind having a buoyant hull which encloses air when inverted.

3. The apparatus of claim 2 wherein the flexible tube has an internal volume which is less than normal lung capacity to allow breathing in both directions through the tube.

4. The apparatus according to claim 1 including a life jacket or buoyancy aid, said tube being attached thereto and having one end including said valve and mouthpiece and located within reach of the user for breathing into, and the other end being capable of being retained within the interior of a hull of a vessel at a level above the waterline of the vessel when inverted.

5. A vessel of the kind having a buoyant hull which encloses air when inverted and comprising an apparatus according to claim 1 in which one of the flexible tube communicates with the interior of the vessel hull and the other end of the flexible tube is located in a position where it can be reached by the user for breathing into and the inlet of the tube is above the waterline within the vessel when the vessel is inverted.

* * * * *